United States Patent [19]

Honda et al.

[11] Patent Number: 4,475,497

[45] Date of Patent: Oct. 9, 1984

[54] INTERNAL COMBUSTION ENGINE HAVING AN INTAKE/EXHAUST VALVE ASSEMBLY AND HYDRAULIC MEANS FOR RENDERING THE VALVE ASSEMBLY INOPERATIVE

[75] Inventors: Shoichi Honda; Masaaki Matsuura, both of Tokyo; Nobuo Anno, Urawa, all of Japan

[73] Assignee: Honda Giken Kogyo Kabushiki Kaisha, Tokyo, Japan

[21] Appl. No.: 439,623

[22] Filed: Nov. 4, 1982

[30] Foreign Application Priority Data

Nov. 4, 1981 [JP] Japan ..... 56-176655
Nov. 4, 1981 [JP] Japan ..... 56-176656

[51] Int. Cl.[3] ..... F01L 1/24

[52] U.S. Cl. ..... 123/198 F; 123/90.16; 123/90.55

[58] Field of Search ..... 123/90.16, 90.15, 90.46, 123/90.12, 198 F, 90.55, 90.27; 251/94

[56] References Cited

U.S. PATENT DOCUMENTS 3,314,404 4/1967 Thompson ..... 123/90.27
3,400,696 9/1968 Thompson ..... 123/90.27
4,004,558 1/1977 Scheibe ..... 123/90.27
4,258,671 3/1981 Takizawa ..... 123/90.16

FOREIGN PATENT DOCUMENTS 2068495 8/1981 United Kingdom ..... 123/90.16

*Primary Examiner*—Michael Koczo

*Assistant Examiner*—Peggy A. Neils

*Attorney, Agent, or Firm*—Armstrong, Nikaido, Marmelstein & Kubovcik

[57] ABSTRACT

An intake/exhaust valve assembly of an internal combustion engine, comprising a reciprocating valve movable into and out of the combustion chamber, a cam driven for rotation by the crankshaft, a cam follower intervening between the cam and the reciprocating valve, a control plunger slidable between first and second axial positions in a main axial bore and defining a pressure-acting chamber in the main axial bore, the control plunger being formed with a passageway open at one end to the pressure-acting chamber and at the other end through the peripheral wall of the plunger, the plunger being operative and inoperative to bear the force transmitted from the cam through the cam follower when the control plunger is in the first and second axial positions, respectively, a check valve providing one-way communication from the passageway in the plunger to the pressure-acting chamber, a fluid discharge chamber open to the pressure-acting chamber, a fluid outlet passageway communicable with the fluid discharge chamber, a pressure-release valve having a condition providing communication between the fluid discharge chamber and the fluid outlet passageway and a condition blocking the communication, a valve actuator to actuate the pressure-release valve under predetermined conditions of the engine, and fluid supply means communicable with the passageway in the control plunger.

10 Claims, 4 Drawing Figures

INTERNAL COMBUSTION ENGINE HAVING AN INTAKE/EXHAUST VALVE ASSEMBLY AND HYDRAULIC MEANS FOR RENDERING THE VALVE ASSEMBLY INOPERATIVE

FIELD OF THE INVENTION

The present invention relates to a intake/exhaust valve assembly of an internal combustion engine.

BACKGROUND OF THE INVENTION

An internal combustion engine is known which comprises a plurality of power cylinders each having intake and exhaust valves which are made operative or inoperative depending upon the load conditions of the engine. Under high load conditions of the engine, the intake and exhaust valves of all the power cylinders are maintained operative and, under medium to low load conditions of the engine, the intake and exhaust valves of one or more power cylinder are made inoperative under the control of an intake/exhaust valve assembly. An example of such an intake/exhaust valve assembly is shown in Japanese Provisional patent publication No. 54-36415. The intake/exhaust valve assembly therein shown is however not fully acceptable for its disproportionately intricate and large-sized construction which requires a considerably high production cost. The present invention aims at provision of an improved intake/exhaust valve assembly eliminating such drawbacks of a prior-art intake/exhaust valve assembly.

SUMMARY OF THE INVENTION

In accordance with the present invention, there is provided an intake/exhaust valve assembly of an internal combustion engine including an engine block having a combustion chamber formed therein, comprising (1) a reciprocating valve axially movable back and forth into the combustion chamber; (2) a cam rotatable about an axis fixed with respect to the engine block at a speed variable with the speed of rotation of the crankshaft of the engine; (3) a cam follower engaging at one end with the reciprocating valve, the cam being held in rollable engagement with the cam follower; (4) adjusting means comprising a cylinder wall which is stationary with respect to the engine block and which is formed with a main axial bore open at one end thereof and closed at the other end thereof, and an auxiliary axial bore open at one end to the main axial bore adjacent the closed end of the main axial bore, a control plunger axially slidable between predetermined first and second axial positions in the main axial bore and having an end wall defining a pressure-acting chamber in the main axial bore, the control plunger being formed with a passageway which is open at one end thereof to the pressure-acting chamber and at the other end thereof through a peripheral wall portion of the plunger, the cam follower pivotally engaging the control plunger, the control plunger being operative and inoperative to bear the force transmitted thereto from the cam through the cam follower when the control plunger is in the first and second axial positions thereof, and one-way check valve means providing one-way communication from the passageway to the pressure-acting chamber; (5) a hollow member defining in the auxiliary axial bore a fluid discharge chamber open to the pressure-acting chamber; the cylinder wall being further formed with a fluid outlet passageway communicable with the fluid discharge chamber; (6) pressure-release valve means positioned in the fluid discharge chamber and having a first condition providing communication between the fluid discharge chamber and the fluid outlet passageway and a second condition blocking the communication therebetween; (7) valve actuating means operative to actuate the pressure-release valve means under predetermined operational conditions of the engine; and (8) fluid supply means communicable with the passageway in the control plunger.

BRIEF DESCRIPTION OF THE DRAWINGS

The features and advantages of an intake/exhaust valve assembly according to the present invention will be more clearly appreciated from the following description taken in conjunction with the accompanying drawings in which like reference numerals designate similar or corresponding units, members and elements and in which.

DESCRIPTION OF THE PREFERRED EMBODIMENTS

Figure 1:
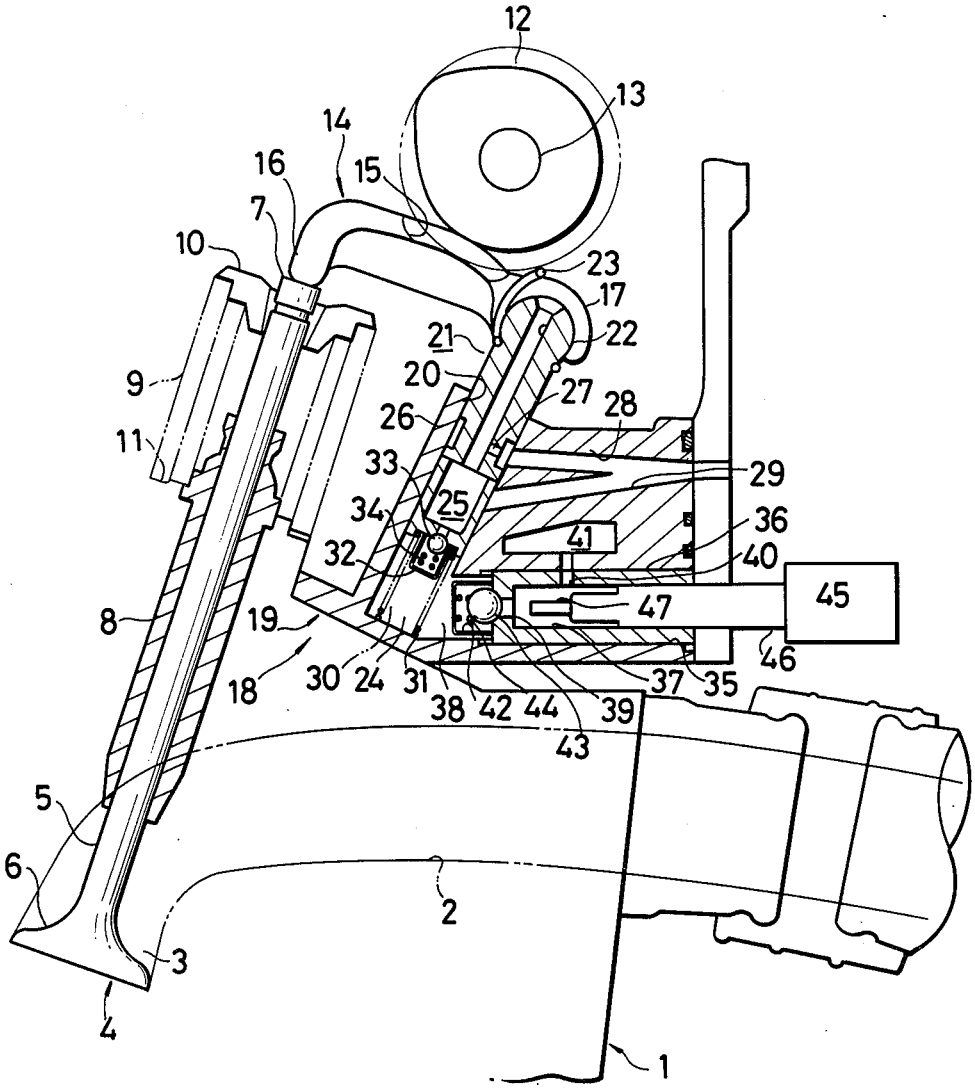
FIG. 1 is a sectional view showing a first preferred embodiment of an intake/exhaust valve assembly according to the present invention, the valve assembly herein shown being in an operative condition.
Figure 2:
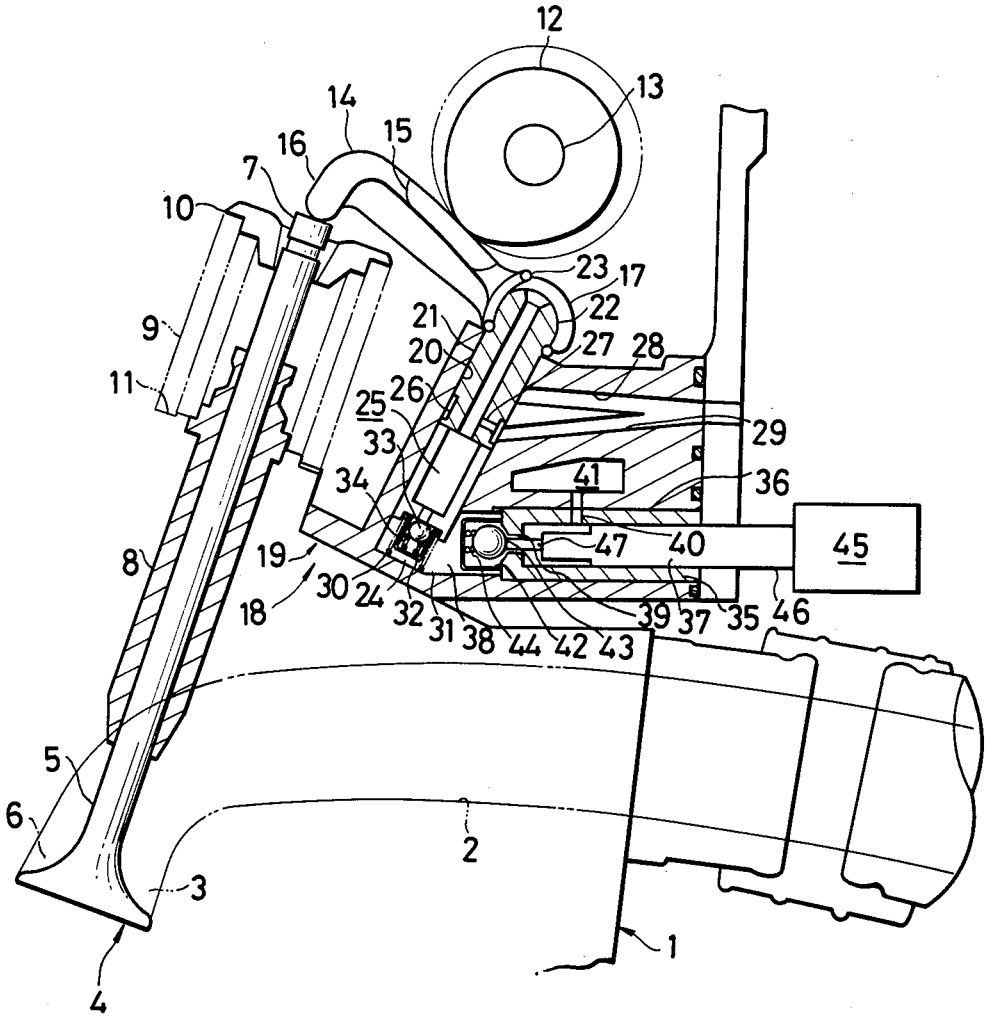
FIG. 2 is a view similar to FIG. 1 but shows the intake/exhaust valve assembly in an inoperative condition.

Referring to FIGS. 1 and 2 of the drawings, an internal combustion engine incorporating a first preferred embodiment of an intake/exhaust valve assembly according to the present invention is assumed to be of the overhead camshaft design and is shown comprising a cylinder head 1 formed with an intake or exhaust passageway 2. The intake or exhaust passageway 2 is one of a plurality of intake or exhaust passageways respectively leading from an intake manifold or to an exhaust manifold, though not shown in the drawings. The intake or exhaust passageway 2 terminates or originates in an intake or exhaust port 3 which is open to the combustion chamber (not shown) of one of the power cylinders of the engine past a reciprocating valve 4 constituting an intake or exhaust valve and forming part of the intake/exhaust valve assembly embodying the present invention. The reciprocating valve 4 is of the poppet type as shown and has an elongated valve stem 5 axially projecting into the intake or exhaust port 3, a circular valve head 6 flaring from one end of the valve stem 5 into the combustion chamber of the power cylinder, and a tip portion 7 opposite to the valve head 6. The valve stem 5 is longitudinally slidable through a tubular valve guide 8 securely fitted to the cylinder head 1 so that the reciprocating valve 4 is axially movable with respect to the cylinder head 1 into and out of a position closing the intake or exhaust port 3 by the valve head 6. The reciprocating valve 4 is urged to stay in the position thus closing the intake or exhaust port 3 by suitable biasing means such as a preloaded helical compression spring 9 seated at one end thereof on a spring retainer ring 10 securely fitted to the valve stem 5 adjacent the tip portion 7 of the valve 4 and at the other end thereof on an interior wall portion of the cylinder head 1.

The reciprocating valve 4 is driven to move cyclically into and out of the position closing the intake or exhaust port under the control of a cam 12 securely carried on a camshaft 13. The cam 12 is one of a plurality of intake or exhaust timing cams which are carried on the camshaft 12 and respectively allocated to the individual power cylinders of the engine. The camshaft 13 and accordingly the cam 12 are driven for rotation about the center axis of the camshaft 13 from the crankshaft (not shown) of the engine through, for example, sprocket wheels and an endless chain or by the combination of gears, as well known in the art. A cam follower 14 to serve as a rocker arm operatively intervenes between the cam 12 and the reciprocating valve 4 so as to intermittently drive the valve 4 for movement into and out of the above mentioned position to close the intake or exhaust port 3. The cam follower 14 has an intermediate slipper portion 15 with which the cam 12 is held in rollable contact, a rocking end portion 16 held in abutting engagement with the tip portion 7 of the reciprocating valve 4, and a socket portion 17 constituted by another end portion of the cam follower 14 and formed with a semispherical concavity. The camshaft 13 is driven for rotation about the center axis thereof at a speed proportional in a predetermined ratio to the speed of rotation of the crankshaft of the engine and causes the cam 12 to press the slipper portion 15 of the cam follower 14 intermittently by the cam lobe portion thereof. The cam follower 14 thus driven for rocking motion and causes the reciprocating valve 4 to reciprocate into and out of the position to close the intake or exhaust port 3 in cycles variable with the speed of rotation of the engine crankshaft.

The intake/exhaust valve assembly embodying the present invention further comprises adjusting means 18 for selectively providing a fixed pivot point about which the cam follower 14 is to rock in response to the rotation of the cam 12 for transmitting the rotation of the cam 12 to the reciprocating valve 5. Such adjusting means 18 comprises a cylinder wall 19 securely connected to or forming part of the cylinder head 1 and formed with a main axial bore 20. An elongated control plunger 21 is axially slidable in the axial bore 20 and has a ball-shaped pivot end portion 22 projecting outwardly from the bore 20. The pivot end portion 22 of the control plunger 21 is slidably received in the concave socket portion 17 of the cam follower 14 and is retained to the cam follower 14 by means of a clip spring 23 straddling on the socket portion 17 of the cam follower 14 and wound on the pivot end portion 22 of the control plunger 21. The control plunger 21 axially projects into the axial bore 20 in the cylinder wall 19 and thus defines a variable-volume pressure-acting chamber 24 in the bore 20. The control plunger 21 has an axial passageway 25 which is open at one end thereof to the pressure-acting chamber 24 and a circumferential groove 26 formed in an outer peripheral wall of the plunger 21 and communicating with the axial passageway 25 through a radial passageway 27 also formed in the plunger 21. The cylinder wall 19 is further formed with first and second fluid passageways 28 and 29 jointly communicating with a suitable source (not shown) of fluid under pressure and terminating in the axial bore 20 in the cylinder wall 19. The respective terminal ends of the first and second passageways 28 and 29 are located in such a manner as to be open to the circumferential groove 26 in the control plunger 21 when the control plunger 21 assumes predetermined first and second axial positions with respect to the cylinder wall 19 as shown in FIGS. 1 and 2, respectively. The control plunger 21 is urged by suitable biasing means to stay in the first axial position having the circumferential groove 26 open to the first fluid passageway. In the embodiment herein shown, the biasing means comprises a preloaded helical compression spring 30 which is housed within the pressure-acting chamber 24 and which is seated at one end thereof on the inner end wall of the control plunger 21 and at the other end thereof on an internal surface 31 of the cylinder wall 19 defining the inner axial end of the pressure-acting chamber 24 as shown. The control plunger 21 is provided with one-way check valve means adapted to provide one-way communication from the axial passageway 25 in the control plunger 21 to the pressure-acting chamber 24 in the cylinder wall 19. The one-way check valve means is shown comprising a cup-shaped ball retainer 32 secured to the inner end wall of the control plunger 21, and a valve ball 33 housed within the ball retainer 32 and movable into and out of a position seated on the end wall of the plunger 21 and thereby closing the axial passageway 25 at the inner axial end of the plunger 21. The valve ball 33 is urged to stay in such a position by means of a preloaded helical compression spring 34 which is housed in the ball retainer 32 and which is seated at one end thereof on the valve ball 33 and at the other end thereof on an end wall of the ball retainer 34.

The cylinder wall 19 is further formed with an auxiliary axial bore 35 extending approximately at right angles to the main axial bore 20 and open at its axial inner end to an inner axial end portion of the pressure-acting chamber 24. A cylindrical sleeve 36 is securely fitted to the cylinder wall 19 through the auxiliary axial bore 35 and is formed with an axial bore 37. The sleeve 36 has an inner end wall axially retracted away from the pressure-acting chamber 24 and thus forming a fluid discharge chamber 38 in the auxiliary axial bore 35. The sleeve 36 further has an axial nozzle 39 formed in this end wall for providing communication between this fluid discharge chamber 38 and the axial bore 37 in the sleeve 36 and a radial aperture 40 formed in a peripheral wall portion of the sleeve 36. The radial aperture 40 communicates with a fluid outlet passageway 41 formed in the cylinder wall 19 and leading to a suitable fluid reservoir (not shown). The cylindrical sleeve 36 thus arranged is provided with pressure-release valve means adapted to drain fluid from the pressure-acting chamber 24 when actuated. The pressure-release valve means comprises a cup-shaped ball retainer 42 secured to the inner end wall of the sleeve 36, and a valve ball 43 housed within the ball retainer 42 and movable into and out of a position seated on the end wall of the sleeve 36 and thereby closing the nozzle 39 as shown in FIG. 1. The valve ball 43 is urged to stay in such a position by means of a preloaded helical spring 44 which is housed in the ball retainer 42 and which is seated at one end thereof on the valve ball 43 and at the other end thereof on an end wall of the ball retainer 44. A solenoid-operated valve actuator unit 45 is mounted on the cylinder head 1 and has a plunger 46 which projects axially into the axial bore 37 in the sleeve 36. The plunger 46 has a tip portion 47 which is axially aligned with the nozzle 39 in the end wall of the sleeve 36 and which is smaller in cross section than the nozzle 39. The plunger 46 is axially slidable through the bore 36 in the sleeve 35 into and out of an axial position in which the tip portion 47 thereof axially extends through the nozzle 39 and is held in abutting engagement at its leading end with the valve ball 43 so that the ball 43 is unseated from the inner end wall of the sleeve 36 against the opposing force of the spring 44. Though not shown in the drawings, the valve actuator unit 45 has incorporated therein a solenoid coil which is electrically connected to a power source across suitable manually-operated or automatically-operated switch means. The automatically-operated switch means may be of the type using a diaphragm responsive to the vacuum developed in the induction system of the internal combustion engine. In the embodiment herein shown, it is assumed by way of example, that the plunger 46 of the valve actuator unit 45 remains retracted from the above mentioned axial position when the solenoid coil of the actuator unit 45 is de-energized.

When, now, the engine is in operation, the camshaft 13 is continuously driven for rotation about the center axis thereof from the crankshaft of the engine. The rotation of the camshaft 13 is accompanied by the rotation of the individual cams on the camshaft 13 so that the cam lobe portion of each cam attempts to drive the respectively associated intake or exhaust valve for reciprocating motions in each power cylinder of the engine in cycles synchronized with the rotation of the crankshaft. If, in this instance, the switch means intervening between the solenoid coil of the valve actuator unit 45 and the power source therefor is kept open, the solenoid coil remains de-energized and as a consequence the plunger 46 of the valve actuator unit 45 is maintained in an axial position retracted away from the nozzle 39 in the sleeve 36 as shown in FIG. 1. The valve ball 43 of the pressure-release valve means is therefore seated on the inner end wall of the sleeve 36 by the force of the spring 44 and closes the nozzle 39 in the sleeve 36. Under these conditions, fluid under pressure is directed into the axial passageway 25 in the control plunger 21 through one of the first and second fluid passageways 28 and 29 in the cylinder wall 19 and the circumferential groove 26 in the control plunger 21 and acts on the valve ball 33 of the one-way check valve means. The valve ball 33 is thus caused to be unseated from the inner end wall of the control plunger 21 against the opposing force of the spring 34 and allows the axial passageway 25 in the control plunger 21 to be open to the pressure-acting chamber 24. A fluid pressure is in this fashion developed in the pressure-acting chamber 24 and, in cooperation with the spring 30, forces the control plunger 21 to fixedly remain in the first axial position with respect to the cylinder wall 19 as shown in FIG. 1 and enables the control plunger 21 to bear the force transmitted from the cam lobe portion of the cam 12 through the cam follower 14. The cam follower 14 is therefore permitted to pivotally move about the center point of the pivot end portion 22 of the control plunger 21 thus fixed with respect to the cylinder wall 19 and to translate the rotation of the cam 12 into reciprocating movement of the reciprocating valve 4 so that the power cylinder including the reciprocating valve 4 is held operative.

If, on the other hand, the switch means intervening between the solenoid coil of the valve actuator unit 45 and the power source therefor is closed, the solenoid coil is energized and as a consequence the plunger 46 of the valve actuator unit 45 is maintained in the axial position having its tip portion 47 held in abutting contact with the valve ball 43 of the pressure-release valve means through the nozzle 39 in the sleeve 36 as shown in FIG. 2. The valve ball 43 is therefore unseated from the inner end wall of the sleeve 36 against the force of the spring 44 and allows the nozzle 39 in the sleeve 36 to be open to the fluid discharge chamber 38. Under these conditions, the fluid pressure developed in the pressure-acting chamber 24 is passed through the nozzle 39 into the axial bore 37 in the sleeve 36 and further by way of the radial aperture 40 in the sleeve 36 and the fluid outlet passageway in the cylinder wall 19 to the fluid reservoir (not shown). The fluid being thus discharged from the pressure-acting chamber 24, the control plunger 21 is caused to withdraw into the main axial bore 20 in the cylinder wall 19 and assumes the second axial position thereof with respect to the cylinder wall 19 against the force of the spring 30 when the cam follower 14 is forced to move by the cam lobe portion of the cam 12 as shown in FIG. 2. As the cam lobe portion turns past the slipper portion 15 of the cam follower 14, the control plunger 21 is caused to move backwardly from the second axial position toward the first axial position thereof by the force of the spring 30. The control plunger 21 is in this manner driven to move back and forth between the first and second axial positions thereof with respect to the cylinder wall 19 and is as a consequence disabled from bearing the force transmitted from the cam lobe portion of the cam 12 through the cam follower 14. The cam follower 14 is thus driven to rock about the tip of the rocking end portion 16 thereof and can not transmit the rotation of the cam 12 to the reciprocating valve 4 with the result that the power cylinder including the reciprocating valve 4 is held inoperative. The spring 30 is selected to have a spring constant which is such that will not enable the control plunger 21 to bear the force transmitted thereto from the cam lobe portion of the cam 12 through the cam follower 14.

When the control plunger 21 is being moved between the first and second axial positions thereof with respect to the cylinder wall 19, the fluid in the fluid passageway 28 or 29 is admitted into the pressure-acting chamber 24 through the circumferential groove 26 and the axial passageway 25 and past the valve ball 33 each time the control plunger 21 reaches the first or second axial position thereof. The fluid thus admitted into the pressure-acting chamber 24 is discharged from therefrom past the valve ball 43 in the fluid discharge chamber 38 but serves to moderate the reciprocating movement of the control plunger 21.

When the switch means intervening between the solenoid coil of the valve actuator unit 45 and the power source therefor is thereafter made open, the solenoid coil is deenergized and as a consequence the plunger 46 of the valve actuator unit 45 is moved into the axial position retracted away from the nozzle 39 in the sleeve 36 as shown in FIG. 1. The valve ball 43 of the pressure-release valve means is therefore seated on the inner end wall of the sleeve 36 by the force of the spring 44 and closes the nozzle 39 in the sleeve 36. Under these conditions, the fluid admitted into the pressure-acting chamber 24 when the control plunger 21 is moved to the first or second axial position thereof is entrapped in the pressure-acting chamber 24 and forces the control plunger 21 to stay in the first axial position thereof with respect to the cylinder wall 19. The control plunger 21 is now enabled to bear the force transmitted from the cam lobe portion of the cam 12 through the cam follower 14 so that the cam follower 14 is driven to pivotally move about the center point of the pivot end portion 22 of the control plunger 21 and to translate the rotation of the cam 12 into reciprocating movement of the reciprocating valve 4, making operative the power cylinder including the reciprocating valve 4. When the control plunger 21 is being moved toward the first axial position thereof by the fluid pressure developed in the fluid discharge chamber 38, the fluid pressure remaining in the axial bore 37 in the sleeve 36 temporarily aids in the movement of the plunger 21 until the nozzle 39 in the sleeve 36 is fully closed by the valve ball 43.

Figure 3:
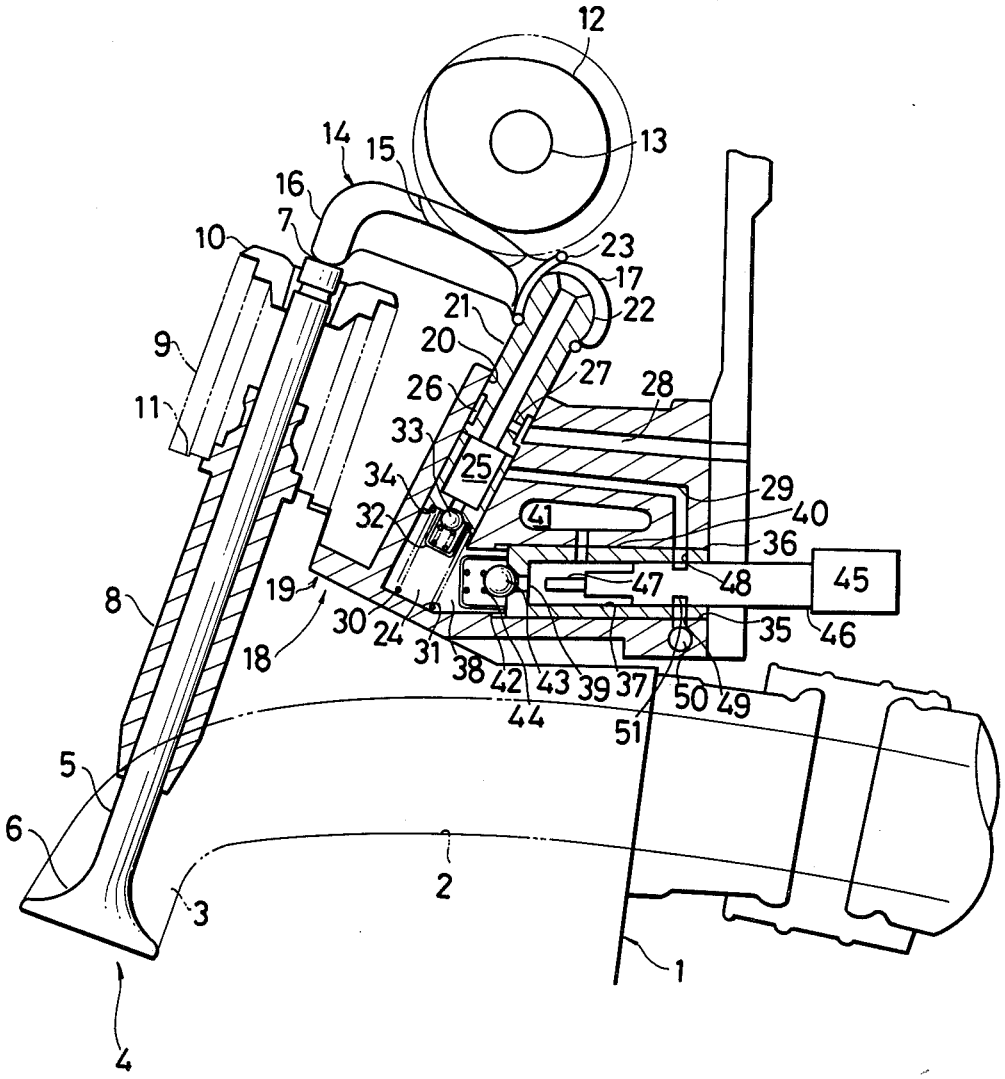
FIG. 3 is a sectional view showing a second preferred embodiment of an intake/exhaust valve assembly according to the present invention, the valve assembly herein shown being in an operative condition.
Figure 4:
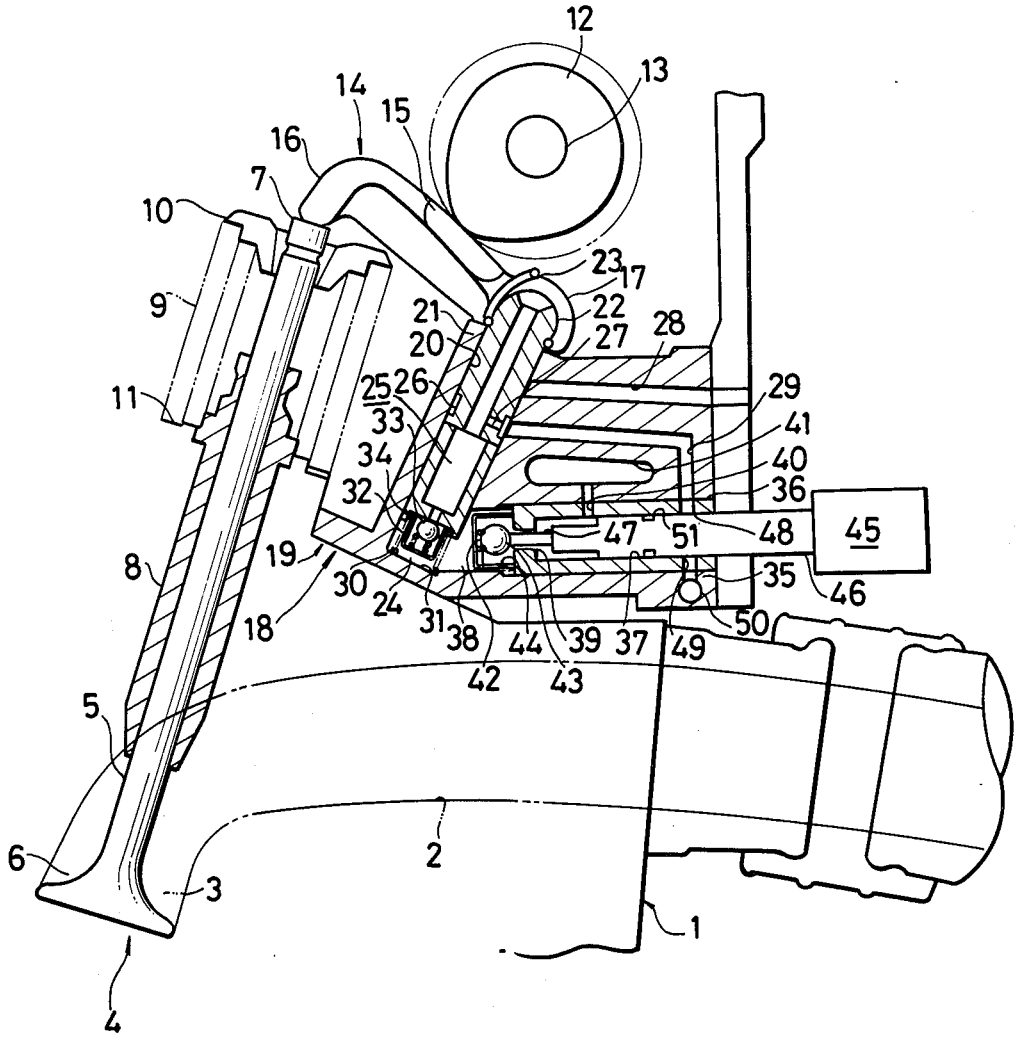
FIG. 4 is a view similar to FIG. 3 but shows the intake/exhaust valve assembly in an inoperative condition.

FIGS. 3 and 4 show a second preferred embodiment of an intake/exhaust valve assembly according to the present invention. The embodiment herein shown is a modification of the embodiment hereinbefore described with reference to FIGS. 1 and 2 and is largely similar thereto except for the arrangement of the second fluid passageway 29. In the intake/exhaust valve assembly shown in FIGS. 3 and 4, the second fluid passageway 29 is formed separately of the first fluid passageway 28 in the cylinder wall 19 and is open at one end thereof to the main axial bore 20 and at the other end to the auxiliary axial bore 35. The sleeve 36 in the auxiliary axial bore 35 is formed with first and second fluid ports 48 and 49 located on a plane perpendicular to the direction of elongation of the sleeve 36. The first fluid port 48 is open to the second fluid passageway 29, which is therefore open to the axial bore 37 in the sleeve 36. The second fluid port 49 is open to a fluid inlet passageway 50 formed in the cylinder wall 19 and leading from the previously mentioned source of fluid under pressure. The plunger 46 of the valve actuator unit 45 is formed with a circumferential groove 51 which is located to radially open to the first and second fluid ports 48 and 49 in the sleeve 36 when the plunger 46 is retracted away from the nozzle 39 in the inner end wall of the sleeve 36 as shown in FIG. 3.

When the plunger 46 of the valve actuator unit 45 is held in the axial position retracted away from the nozzle 39, the second fluid passageway 29 is permitted to communicate with the fluid source through the first fluid port 48 in the sleeve 36, the circumferential groove 51 in the plunger 46, the second fluid port 49 in the sleeve 36 and the fluid inlet passageway 50 in the cylinder wall 19. When the power cylinder including the reciprocating valve 4 is maintained operative, the fluid supplied from the fluid source is thus constantly directed not only to the first fluid passageway 28 but to the second fluid passageway 29 as in the embodiment described with reference to FIGS. 1 and 2. When, on the other hand, the plunger 46 of the valve actuator unit 45 is held in the axial position projecting into the nozzle 39 in the sleeve 36, the first and second fluid ports 48 and 49 in the sleeve 36 are closed by the plunger 46 so that the second fluid port 29 is isolated from the fluid inlet passageway 50 and accordingly from the fluid source as will be seen from FIG. 4. When the power cylinder including the reciprocating valve 4 is maintained inoperative, the control plunger 21 once moved into the second axial position thereof is disabled from being moved back to the first axial position thereof due to an increased resistance resulting from the oil or air admitted into or discharged out of the pressure-acting chamber 24 although the control plunger 21 attempts to move toward the first axial position thereof by the force of the spring 30. The control plunger 21 is for this reason held in the second axial position thereof so that the cam follower 14 is precluded from striking against the cam lobe portion of the cam 12.

The fluid pressure to act on the valve ball 43 of the pressure-release valve means pulsates usually with the range of between about 0 kg/cm$^2$ (or slightly lower than 0 kg/cm$^2$) and about 400 kgs/cm$^2$ in each of the embodiments hereinbefore described. The valve actuator unit 45 in a valve assembly according to the present invention can therefore be so designed as to be capable of exerting a force of only such a degree that is required for overcoming the force of the compression spring 44 when moving the valve ball 43 away from the nozzle 39 in the sleeve 36 and can therefore be of a simple and economical construction.

What is claimed is:

1. An intake/exhaust valve assembly of an internal combustion engine including an engine block having a combustion chamber formed therein, comprising:

(1) a reciprocating valve axially movable back and forth into and out of the combustion chamber;

(2) a cam rotatable about an axis fixed with respect to the engine block at a speed variable with the speed of rotation of the crankshaft of the engine;

(3) a cam follower engaging at one end with the reciprocating valve, said cam being held in rollable engagement with the cam follower;

(4) adjusting means comprising a cylinder wall which is stationary with respect to said engine block and which is formed with a main axial bore open at one end thereof and closed at the other end thereof, and an auxiliary axial bore being at one end thereof open to and integral with said main axial bore adjacent the closed end of the main axial bore, said cylinder wall being further formed with a fluid drain passageway communicable with said auxiliary axial bore, a control plunger axially slidable between predetermined first and second axial positions in said main axial bore and having an end wall defining a pressure-acting chamber in the main axial bore, the control plunger being formed with a passageway which is open at one end thereof to said pressure-acting chamber and at the other end thereof through a peripheral wall portion of the plunger, said cam follower pivotally engaging said control plunger, said control plunger being operative and inoperative to bear the force transmitted thereto from said cam through said cam follower when the control plunger is in said first and second axial positions, respectively, thereof, and one-way check valve means providing one-way communication from said passageway to said pressure-acting chamber;

(5) pressure-release valve means positioned in said auxiliary axial bore so as to form a fluid discharge chamber open to and integral with said pressure-acting chamber and having a first condition providing communication between the fluid discharge chamber and the fluid drain passageway and a second condition blocking the communication therebetween;

(6) valve actuating means operative to actuate the pressure-release valve means under predetermined operational conditions of the engine; and (7) fluid supply means communicable with the passageway in said control plunger.

2. An intake/exhaust valve assembly as set forth in claim 1, in which said valve actuating means comprises a plunger axially slidably movable through said axial bore of said hollow member and engageable at one end thereof with said pressure-release valve element when moved in one direction toward said bottom end of said hollow member, and drive means operative to drive said plunger for movement in said direction through said axial bore under said predetermined operational conditions of said engine.

3. An intake/exhaust valve assembly of an internal combustion engine including an engine block having a combustion chamber formed therein, comprising:

(1) a reciprocating valve axially movable back and forth into and out of the combustion chamber;

(2) a cam rotatable about an axis fixed with respect to the engine block at a speed variable with the speed of rotation of the crankshaft of the engine;

(3) a cam follower engaging at one end with the reciprocating valve, said cam being held in rollable engagement with the cam follower;

(4) adjusting means comprising a cylinder wall which is stationary with respect to said engine block and which is formed with a main axial bore open at one end thereof and closed at the other end thereof, and an auxiliary axial bore being at one end thereof open to and integral with said main axial bore adjacent the closed end of the main axial bore, said cylinder wall being further formed with a fluid drain passageway communicable with said auxiliary axial bore, a control plunger axially slidable between predetermined first and second axial positions in said main axial bore and having an end wall defining a pressure-acting chamber in the main axial bore, the control plunger being formed with a passageway which is open at one end thereof to said pressure-acting chamber and at the other end thereof through a peripheral wall portion of the plunger, said cam follower pivotally engaging said control plunger, said control plunger being operative and inoperative to bear the force transmitted thereto from said cam through said cam follower when the control plunger is in said first and second axial positions, respectively, thereof, and one-way check valve means providing one-way communication from said passageway to said pressure-acting chamber;

(5) pressure-release valve means positioned in said auxiliary axial bore so as to form a fluid discharge chamber open to and integral with said pressure-acting chamber and having a first condition providing communication between the fluid discharge chamber and the fluid drain passageway and a second condition blocking the communication therebetween;

(6) valve actuating means operative to actuate the pressure-release valve means under predetermined operational conditions of the engine; and (7) fluid supply means for supplying fluid under pressure to the passageway in said control plunger, the fluid supply means comprising first and second passageway means communicatable with the passageway in said control plunger when the control plunger is in said first and second axial positions, respectively, thereof with respect to the cylinder wall.

4. An intake/exhaust valve assembly as set forth in claim 3, in which said fluid supply means further comprises fluid shut-off valve means operative to cut off the supply of fluid to the passageway in said control plunger through said second passageway means.

5. An intake/exhaust valve assembly as set forth in claim 1 in which said plunger forms part of said fluid shut-off valve means and is axially movable through the axial bore in said hollow member into and out of a predetermined axial position closing said fluid passageway.

6. An intake/exhaust valve assembly as set forth in claim 1, in which said pressure-release valve means includes a hollow member having therethrough an axial bore which is opened at a top end thereof and is closed at a bottom end thereof while remaining a small bore at the bottom wall thereof and being accommodated in said auxiliary axial bore so as to define a fluid discharge chamber communicable with said axial bore through said small bore and integrally opened to said pressure-acting chamber, a pressure-release valve element seated on the outer end of said small bore, and biasing means for urging said valve element onto the outer end of said small bore.

7. An intake/exhaust valve assembly as set forth in claim 2, in which said small bore has an inner diameter smaller than that of said axial bore of the hollow member, and in which said plunger has said one end portion formed into a tip end portion with a reduced outer diameter than the remaining portion thereof so that said tip end portion is inserted into said small bore when said plunger moves in said direction thereby to push said valve element against said biasing means.

8. An intake/exhaust valve assembly as set forth in claim 4, in which said pressure-release valve means includes a hollow member having therethrough an axial bore which is opened at a top end thereof and is closed at a bottom end thereof while remaining a small bore at the bottom wall thereof and being accommodated in said auxiliary axial bore so as to define a fluid discharge chamber communicable with said axial bore through said small bore and integrally opened to said pressure-acting chamber, a pressure-release valve element seated on the outer end of said small bore, and biasing means for urging said valve element onto the outer end of said small bore, and biasing means for urging said valve element onto the outer end of said small bore.

9. An intake/exhaust valve assembly as set forth in claim 8, in which said valve actuating means comprises a plunger axially slidably movable through said axial bore of said hollow member and engageable at one end thereof with said pressure-release valve element when moved in one direction toward said bottom end of said hollow member, and drive means operative to drive said plunger for movement in said direction through said axial bore under said predetermined operational conditions of the engine.

10. An intake/exhaust valve assembly as set forth in claim 8, in which said small bore has an inner diameter small than that of said axial bore of the hollow member, and in which said plunger has said one end thereof formed into a tip end portion with a reduced outer diameter than the remaining portion thereof so that said tip end portion is inserted into small bore when said plunger moves in said direction thereby to push said valve element against said biasing means.

* * * * *